US007179364B2

(12) United States Patent
O'Rear et al.

(10) Patent No.: US 7,179,364 B2
(45) **Date of Patent: *Feb. 20, 2007**

(54) PRODUCTION OF STABLE OLEFINIC FISCHER-TROPSCH FUELS WITH MINIMUM HYDROGEN CONSUMPTION

(75) Inventors: Dennis J O'Rear, Petaluma, CA (US); Guan Dao Lei, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 224 days.

This patent is subject to a terminal disclaimer.

(21) Appl. No.: 10/355,279

(22) Filed: Jan. 31, 2003

(65) Prior Publication Data

US 2004/0173500 A1 Sep. 9, 2004

(51) Int. Cl.
*C10L 1/04* (2006.01)
*C10L 1/08* (2006.01)

(52) U.S. Cl. ..... 208/15; 585/14; 208/950

(58) Field of Classification Search ..... 208/15; 585/14

See application file for complete search history.

(56) References Cited

U.S. PATENT DOCUMENTS

| | | | | |
|---|---|---|---|---|
| 3,149,933 | A * | 9/1964 | Ley et al. | 44/425 |
| 4,125,566 | A | 11/1978 | Trin Dinh et al. | |
| 4,547,601 | A | 10/1985 | Holland et al. | |
| 4,568,663 | A | 2/1986 | Mauldin | |
| 4,645,586 | A | 2/1987 | Buss | |
| 5,322,615 | A | 6/1994 | Holtermann et al. | |
| 5,371,308 | A | 12/1994 | Gosselink et al. | |
| 5,506,272 | A | 4/1996 | Benham et al. | |
| 5,689,031 | A | 11/1997 | Berlowitz et al. | |
| 5,766,274 | A | 6/1998 | Wittenbrink et al. | |
| 6,162,956 | A | 12/2000 | Berlowitz et al. | |
| 6,180,842 | B1 | 1/2001 | Berlowitz et al. | |
| 6,274,029 | B1 | 8/2001 | Wittenbrink et al. | |

(Continued)

FOREIGN PATENT DOCUMENTS

| | | |
|---|---|---|
| EP | 0161705 | 4/1989 |

(Continued)

OTHER PUBLICATIONS

U.S. Appl. No. 10/355,158, O'Rear et al., filed Jan. 31, 2003, High Purity Olefinic Naphthas from the Production of Ethylene and Propylene.

(Continued)

*Primary Examiner*—Ellen M. McAvoy
(74) *Attorney, Agent, or Firm*—Buchanan, Ingersoll & Rooney PC

(57) ABSTRACT

The present invention relates to a stable, low sulfur, olefinic distillate fuel blend component derived from a Fischer-Tropsch process and a process for producing this stable, low sulfur, olefinic distillate fuel blend component. The stable, low sulfur, olefinic distillate fuel comprises olefins in an amount of 2 to 80 weight percent, non-olefins in an amount of 20 to 98 weight percent wherein the non-olefins are predominantly paraffins, oxygenates in an amount of less than 1 weight percent, and sulfur in an amount of less than 10 ppm by weight. A distillate fuel comprising the above blend component forms less than 5 ppm peroxides after storage at 60° C. for four weeks.

20 Claims, 1 Drawing Sheet

U.S. PATENT DOCUMENTS

| | | | | |
|---|---|---|---|---|
| 6,296,757 | B1 | 10/2001 | Wittenbrink et al. | |
| 6,369,286 | B1 * | 4/2002 | O'Rear | 585/644 |
| 6,372,949 | B1 | 4/2002 | Brown et al. | |
| 6,605,206 | B1 | 8/2003 | Johnson et al. | |
| 6,663,767 | B1 * | 12/2003 | Berlowitz et al. | 208/15 |
| 6,743,962 | B2 | 6/2004 | O'Rear et al. | |
| 6,755,961 | B1 * | 6/2004 | Berlowitz et al. | 208/15 |
| 6,776,897 | B2 * | 8/2004 | Bacha et al. | 208/14 |
| 6,846,402 | B2 * | 1/2005 | Hemighaus et al. | 208/14 |
| 6,860,909 | B2 * | 3/2005 | Berlowitz et al. | 44/436 |
| 6,872,752 | B2 * | 3/2005 | O'Rear et al. | 518/700 |
| 2003/0199719 | A1 | 10/2003 | Johnson et al. | |

FOREIGN PATENT DOCUMENTS

| | | | |
|---|---|---|---|
| EP | 609079 | A1 | 8/1994 |
| EP | 0921179 | A1 | 6/1999 |
| WO | 97/14769 | | 4/1997 |
| WO | 98/56740 | | 12/1998 |
| WO | 98/56873 | | 12/1998 |
| WO | 98/56877 | | 12/1998 |
| WO | 03/064354 | | 8/2003 |

OTHER PUBLICATIONS

U.S. Appl. No. 10/354,957, O'Rear et al., filed Jan. 31, 2003, High Purity Olefinic Naphthas from the Production of Ethylene and Propylene.

U.S. Appl. No. 10/355,110, Lei et al., filed Jan. 31, 2003, High Purity Olefinic Naphthas from the Production of Ethylene and Propylene.

U.S. Appl. No. 10/354,956, O'Rear et al., "Low Acid, High Olefin Fischer-Tropsch Distillate Fuel", filed Jan. 31, 2003.

U.S. Appl. No. 10/358,129, Sasol Technology (Pty) Ltd. "Process for the Preparation of and Composition of a Feedstock Usable for the Preparation of Lower Olefins", filed Jan. 31, 2003.

Shah, P.P., "Upgrading of Light Fischer-Tropsch Products, Final Report" Contract No. AC22-86PC90014. DE91011315 (DOE/PC/90014-TB) (1990).

Vardi J. et al. "Peroxide Formation in Low Sulfur Automotive Diesel Fuels" SAE paper 920826 (1992).

Owen, J., "Conversion and uses of liquid fuels from coal", *Coal Research Establishment, National Coal Board Stoke Orchard*, Cheltenham, Glos, GL52 4RZ, UK.

"Ethylene from Mobil Zeolite and F-T route economic by 1990", *ECN Technology*, p. 16.

"Coal-based chemicals complex outlined", *C&EN* p. 7 (1976).

Hutcheon, H.M., "Conference: Industrial Conversion of Coal and Carbon to Gas, Liquid and High-Value Sold Products", *Society of Chemical Industry*, London, (1981).

Hatch, L.F., et al., "From Hydrocarbons to Petrochemicals . . . ", pp. 128-139 (1978).

Goossens, A.G., "Prediction of Molecular Weight of Petroleum Fractions", *IEC Res*. 35:985-988 (1996).

"Ethylene", *Encyclopedia of Chemical Technology*, New York, Ed. 4, vol. 9:877-915.

White, R.A., "Materials Selection for Petroleum Refineries and Gathering Facilities", *NACE International*, Houston (1998), pp. 1-14.

Technical Review Diesel Fuels, *J. Diesel Fuel Refining and Chemistry*, Chevron Products Company.

Shah, P.P., "Upgrading of Light Fischer-Tropsch Products, Final Report", U.S. Dept. of Energy, DE91011315, Nov. 30, 1990.

United Kingdom Search Report dated Jun. 23, 2004.

U.S. Appl. No. 10/043,345, O'Rear et al., filed Jan. 14, 2002, "Olefin Production from Low Sulfur Hydrocarbon Fractions."

U.S. Appl. No. 10/355,280, O'Rear et al., filed Jan. 31, 2003, "Stable Olefinic, Low Sulfur Diesel Fuels."

Chevron Corporation, *Technical Review Diesel Fuels*, Chapter 7 Diesel Fuel Additives pp. 55-61 (1998).

Sundaram, K.M, et al., "Ethylene", *Kirk-Othmer Encyclopedia of Chemical Technology*, Chapter 4, Apr. 16, 2001.

Schlesinger, M.D. and H. E. Benson, "Upgrading Fischer-Tropsch Products", *Industrial and Engineering Chemistry* 47(10):2104-2108 (1954).

Netherlands Search Report dated Jan. 4, 2005.

Robertson, S.D. et al. "Effect of automotive gas oil composition on elastomer behaviour", SAE Fuels & Lubricants meeting (Baltimore Oct. 17-20, 1994) SAE Special Publication N. SP-1056 85-104 (1994).

Roets et al., "Stability and handling of Sasol semisynthetic jet fuel", 6th International conference on Stability and Handling of Liquid Fuels,m Vancouver, B.C., Canada, Oct. 13-17, 19978, pp. 789-804, Publisher National Technical Information Services, Springfield, Virginia.

* cited by examiner

Figure
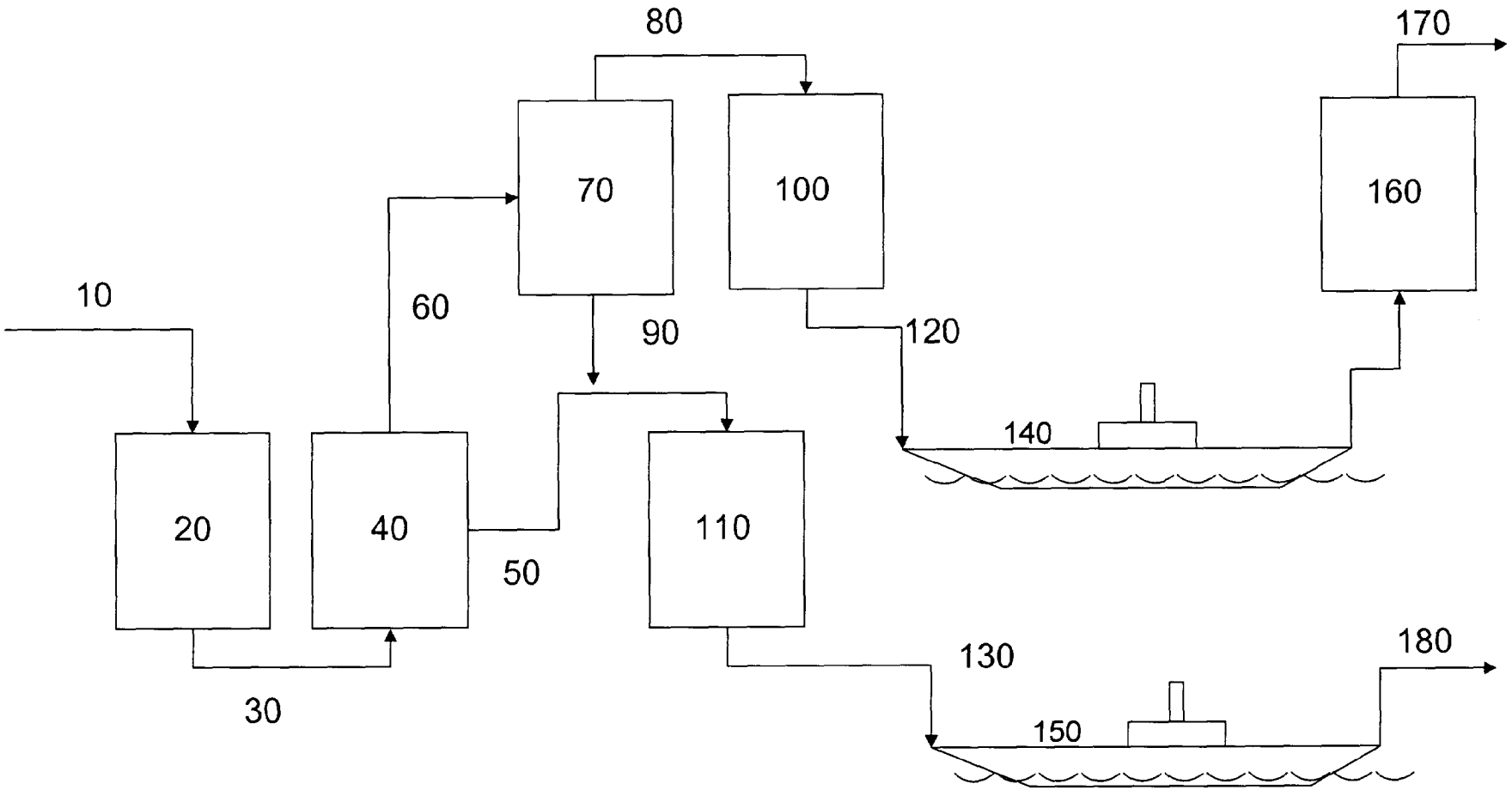

PRODUCTION OF STABLE OLEFINIC FISCHER-TROPSCH FUELS WITH MINIMUM HYDROGEN CONSUMPTION

CROSS-RELATED APPLICATION

The present application is related to U.S. patent application Ser. No. 10/354,956 entitled "Production of Stable Olefinic Fischer-Tropsch Fuels with Minimum Hydrogen Consumption" which is filed herewith.

FIELD OF THE INVENTION

This invention relates to stable, low sulfur, blended distillate fuels wherein at least a portion of the fuel is derived from a Fischer-Tropsch process and Fischer-Tropsch distillate fuel blending components. The invention also relates to processes for producing these stable, low sulfur, blended distillate fuels and the distillate fuel blending components.

BACKGROUND OF THE INVENTION

Stable distillate fuels with low sulfur contents and high cetane numbers are desired because of their low emissions and good engine performance. Fuels of this type can be prepared from Fischer-Tropsch products. The preparation of distillate fuels from Fischer-Tropsch processes is well known.

The Fisher Tropsch process is typically divided into two types—high temperature and low temperature. The high temperature process produces primarily light gaseous products between methane and about $C_8$. The products from high temperature processes are highly olefinic, and distillate fuels are produced by oligomerizing the olefins. The low temperature process produces a heavier product from methane to a material having more than 100 carbon atoms. Depending on the catalyst and process conditions, the product composition can vary from highly paraffinic to a mixture of paraffins, olefins, and oxygenates. The oxygenates are primarily alcohols, but acids may also be present along with smaller quantities of other oxygenates. The structures of the products are primarily linear, e.g. normal paraffins, primarly linear alcohols and fatty acids. When the Fischer-Tropsch product comprises components other than the paraffins, the Fischer-Tropsch product may exhibit problems with stability.

Fischer-Tropsch products from low temperature processes are typically converted into distillate fuels by hydroprocessing operations which saturate the olefins and convert all the oxygenates into paraffins. These processes require the use of expensive hydrogen and expensive high pressure facilities and recycle compressors. It would be preferable not to hydroprocess all of the Fischer-Tropsch products, especially those that are already in the distillate boiling range.

One method to avoid hydroprocessing all of the Fischer-Tropsch products is to simply send the lighter fractions around the hydroprocessing unit and blend them directly into the distillate product without further treatment. The heavier fractions are converted into additional distillate product by hydrocracking. The distillate product from the hydrocracker and the lighter fractions directly from the Fischer-Tropsch process are blended. This type of operation, and the preparation of distillate fuel containing olefins, has been described several times in the literature:

By way of example, "Upgrading of Light Fischer-Tropsch Products, Final Report", by P. P. Shah, Nov. 20, 1990 describes work performed under Contract No. AC22-86PC90014. DE91011315 (DOE/PC/90014-TB). FIG. 4.1 on page 4.14 of the report shows a Fischer-Tropsch product from an Arge reactor being separated into a $C_{12}$–$C_{18}$ fraction and a $C_{19+}$ fraction. The $C_{19+}$ fraction is hydrocracked to form additional $C_{12-18}$ products, and the raw $C_{12-18}$ fraction from the Fischer-Tropsch unit is blended with the $C_{12}$–$C_{18}$ fraction from the hydrocracker to form diesel. Since the $C_{12-18}$ fraction from the Fischer-Tropsch unit will of natural consequence contain oxygenates, alcohols specifically, the blended product will also contain these oxygenates. The text on page 4.3 discloses that the Fischer-Tropsch $C_{12-18}$ product contains oxygenates.

U.S. Pat. No. 5,506,272 also describes a Fischer-Tropsch diesel fuel containing oxygenates. Table 3 in Column 18 describes a Fischer-Tropsch diesel fuel with a cetane index of 62 and containing 6 wt % alcohols and 6 wt % other oxygenates.

U.S. Pat. No. 6,296,757 discloses a blend of hydrocracked wax with unhydrotreated hot and cold condensates. FIG. 1 illustrates how the product of the invention is a blend of hydrocracked wax and unhydrotreated hot and cold condensates. The unhydrotreated hot and cold condensates contain olefins and oxygenates, and therefore, the product taught in this patent will also contain olefins and oxygenates. In particular Example 2, column 6, lines 26–39 teaches a product (Fuel B). An analysis of Fuel B is shown in Table 1 in column 8. Fuel B contains 0.78 mmol/g of olefins as measured by the Bromine No. and 195 ppm oxygen as oxygenates. This Bromine Number is equivalent to a wt % olefins between 0.7 and 0.98 depending on the assumed molecular weight of the olefins.

U.S. Pat. No. 5,689,031 also discloses a clean distillate useful as a diesel fuel or diesel blending stock produced from Fischer-Tropsch wax made by separating wax into heavier and lighter fractions, further separating the lighter fraction, and hydroisomerizing the heavier fraction and that portion of the light fraction below about 500° F. The isomerized product is blended with the untreated portion of the lighter fraction. FIG. 1 illustrates the process for producing the product as described therein. FIG. 1 illustrates that the product is a blend of hydrocracked wax, hydrotreated cold condensate, and unhydrotreated hot condensate. The unhydrotreated hot condensate contains olefins and oxygenates, and therefore, the product contains olefins and oxygenates. In particular, Example 2, column 6, lines 49–61 teaches a product (Fuel B). An analysis of Fuel B is shown in Table 1 in column 8. Fuel B contains 0.78 mmol/g of olefins as measured by the Bromine No. and 195 ppm oxygen as oxygenates. This Bromine Number is equivalent to a wt % olefins between 0.7 and 0.98 depending on the assumed molecular weight of the olefins.

Similarly, U.S. Pat. No. 5,766,274 discloses a clean distillate useful as a jet fuel or jet blending stock produced from Fischer-Tropsch wax by separating wax into heavier and lighter fractions; further separating the lighter fraction and hydroisomerizing the heavier fraction and that portion of the light fraction above about 475° F. The isomerized product is blended with the untreated portion of the lighter fraction to produce jet fuel.

U.S. Pat. No. 6,274,029 discloses diesel fuels or blending stocks produced from non-shifting Fischer-Tropsch processes by separating the Fischer-Tropsch product into a lighter and heavier fractions, e.g., at about 700° F., subjecting the 700° F.+ fraction to hydro-treating, and combining the 700° F.+ portion of the hydrotreated product with the lighter fraction that has not been hydrotreated.

However, none of these processes as described in the prior art addresses the critical issue of stability of the fuel that is produced. Temperature, time, extent of oxygen exposure, impurities, and fuel composition are all important aspects of fuel stability. Fuel stability is determined by thermal stability and storage stability of the fuel. Thermal stability relates to the stability of the fuel when exposed to temperatures above ambient for relatively short periods of time. Storage stability generally relates to the stability of the fuel when stored at near ambient conditions for longer periods of time. A stable fuel can become unstable due to the introduction of other components, including incompatible fuel components. Components, which can cause a fuel to become unstable, include highly aromatic and heteroatom-rich fuel components, metals, oxidation promoters, and incompatible additives.

ASTM specifications for Diesel Fuel (D985) describe stability measurements for the respective fuels. For diesel fuel, ASTM D6468, "Standard Test Method for High Temperature Stability of Distillate Fuels" is under consideration as a standard test method for a diesel fuel and this test can provide a good measure of the stability of the fuel. Neat Fisher Tropsch products typically have excellent stabilities in this test.

In addition to conventional measurements of stability (thermal and storage), studies by Vardi et al (J. Vardi and B. J. Kraus, "Peroxide Formation in Low Sulfur Automotive Diesel Fuels," February 1992, SAE Paper 920826) describe how fuels can develop significant levels of peroxide during storage, and how these peroxides can attack fuel system elastomers (O-rings, hoses, etc.). The formation of peroxides can be measured by Infrared spectroscopy, chemical methods, or by the attack on elastomer samples. As described by Vardi et al, fuels can become unstable with respect to peroxide formation when their sulfur content is reduced to low levels by hydroprocessing. Vardi et al also describe how compounds like tetralin can cause fuels to become unstable with respect to peroxide formation, while polycyclic aromatic compounds like naphthalenes can improve stability. Vardi et al. explains that aromatics act as natural antioxidants and notes that natural peroxide inhibitors such as sulfur compounds and polycyclic aromatics can be removed.

Following on the work by Vardi, two recent patents from Exxon describe how the peroxide-stability of highly-paraffinic Fischer-Tropsch products in unacceptable, but can be improved by the addition of sulfur compounds from other blend components. However, since sulfur compounds increase sulfur emissions, this approach is not desirable.

By way of example, U.S. Pat. No. 6,162,956 discloses a Fischer-Tropsch derived distillate fraction blended with either a raw gas field condensate distillate fraction or a mildly hydrotreated condensate fraction to obtain a stable, inhibited distillate fuel. The fuel is described as a blend material useful as a distillate fuel or as a blending component for a distillate fuel comprising: (a) a Fischer-Tropsch derived distillate comprising a $C_8$–700° F. fraction, and (b) a gas field condensate distillate comprising a $C_8$–700° F. fraction, wherein the sulfur content of the blend material is ≧1 ppm by wt. This patent discloses that distillate fuels derived from Fischer-Tropsch processes are hydrotreated to eliminate unsaturated materials, e.g., olefins, and most, if not all, oxygenates. This patent further discloses that the products contain less than or equal to 0.5 wt % unsaturates (olefins and aromatics).

Similarly, U.S. Pat. No. 6,180,842 discloses a Fischer-Tropsch derived distillate fraction blended with either a raw virgin condensate fraction or a mildly hydrotreated virgin condensate to obtain a stable inhibited distillate fuel. The fuel is describes as a blend material useful as a distillate fuel or as a blending component for a distillate fuel comprising (a) a Fischer-Tropsch derived distillate comprising a $C_8$_700° F. stream and having a sulfur content of less than 1 ppm by wt, and (b) 1–40 wt % of a virgin distillate comprising a $C_8$-700° F. stream; wherein the sulfur content of the blend material is ≧2 ppm by wt. This patent notes that while there is no standard for the peroxide content of fuels, there is general acceptance that stable fuels have a peroxide number of less than about 5 ppm, preferably less than about 4 ppm, and desirably less than about 1 ppm. This value is tested after storage at 60° C. in an oven for 4 weeks. The patent shows that Fischer-Tropsch products having a peroxide number of 24.06 after 4 weeks have unacceptable stability.

The Fischer-Tropsch products in the '842 patent are described as being >80 wt %, preferably >90 wt %, more preferably >95 wt % paraffins, having an iso/normal ratio of 0.1 to 10, preferably 0.3 to 3.0, more preferably 0.7 to 2.0; sulfur and nitrogen of less than 1 ppm each, preferably less than 0.5, more preferably less than 0.1 ppm each; <0.5 wt % unsaturates (olefins and aromatics), preferably <0.1 wt %; and less than 0.5 wt % oxygen on a water free basis, preferably less than about 0.3 wt % oxygen, more preferably less than 0.1 wt % oxygen and most preferably nil oxygen. The '842 patent teaches that the Fischer-Tropsch distillate is essentially free of acids.

U.S. Pat. No. 5,689,031 demonstrates that olefins in low-sulfur diesel fuel contribute to peroxide formation. See Fuels C and D in Example 7, and FIG. 2. The '031 patent teaches that the solution to the peroxide forming tendency is to limit the olefin content by hydrotreating the lightest olefin fraction. However, this solution requires the use of expensive hydrogen gas.

It is desired to produce a distillate fuel that has low sulfur content economically, preferably without or with minimal expensive hydroprocessing, and obtain a diesel fuel that has acceptable stability, measured in terms of thermal stability, storage stability, and peroxide resistance. Therefore, it is desired that the diesel fuel be able to have a high olefin content, for example greater than or equal to 2 weight %, and exhibit acceptable stability.

SUMMARY OF THE INVENTION

The present invention relates to a blended distillate fuel. The blended distillate fuel comprises a) a distillate fuel fraction comprising olefins in an amount of 2 to 80 weight %; non-olefins in an amount of 20 to 98 weight %, wherein the non-olefins comprise greater than 50 weight % paraffins; and oxygenates in an amount of less than 1 weight %; and b) a distillate fuel fraction selected from the group consisting of a hydrotreated Fischer-Tropsch derived distillate fuel, a hydrocracked Fischer-Tropsch derived distillate fuel, a hydrotreated petroleum derived distillate fuel, a hydrocracked petroleum derived distillate fuel, and mixtures thereof. At least a portion of the blended distillate fuel is derived from Fischer-Tropsch synthesis products. The blended distillate fuel comprises sulfur in an amount of less than 10 ppm by weight, has a total acid number of less 1.5, and forms less than 5 ppm peroxides after storage at 60° C. for 4 weeks.

In another aspect the present invention relates to a blended distillate fuel comprising a) a Fischer-Tropsch distillate fuel fraction and b) a distillate fuel fraction selected from the group consisting of a hydrotreated Fischer-Tropsch derived distillate fuel, a hydrocracked Fischer-Tropsch derived distillate fuel, a hydrotreated petroleum derived distillate fuel, a hydrocracked petroleum derived distillate fuel, and mixtures thereof. The Fischer-Tropsch distillate fuel fraction comprises (i) olefins in an amount of 2 to 80 weight %; (ii) non-olefins in an amount of 20 to 98 weight %, wherein the non-olefins comprise greater than 75 weight % paraffins and the paraffins have an i/n ratio of less than 1; and (iii) oxygenates in an amount of less than 1 weight %. The blended distillate fuel comprises (i) sulfur in an amount of less than 1 ppm by weight, (ii) nitrogen in an amount of less than 5 ppm by weight; (iii) aromatics in an amount of less than 5 weight % and (iv) a total acid number of less than 1.5. The blended distillate fuel forms less than 5 ppm peroxides after storage at 60° C. for 4 weeks.

In a further aspect, the present invention relates to a Fischer-Tropsch distillate fuel blend component. The Fischer-Tropsch distillate fuel blend component comprises a) olefins in an amount of 2 to 80 weight %; b) non-olefins in an amount of 20 to 98 weight %, wherein the non-olefins comprise greater than 75 weight % paraffins and the paraffins have an i/n ratio of less than 1; c) oxygenates in an amount of less than 1 weight %; d) sulfur in an amount of less than 1 ppm by weight; e) aromatics in an amount of less than 2 weight %; f) a total acid number of less than 1.5; and g) a boiling range of $C_5$ to 800° F.

In yet another aspect, the present invention relates to a process for producing a distillate fuel blend component. The process comprises converting at least a portion of a hydrocarbon asset to synthesis gas, and converting at least a portion of the synthesis gas to a hydrocarbon stream in a Fischer-Tropsch process unit. A distillate fuel fraction is isolated from the hydrocarbon stream, wherein the distillate fuel fraction comprises 2 to 80 weight % olefins and 20 to 98 weight % non-olefins, wherein the non-olefins comprise greater than 50 weight % paraffins. The distillate fuel fraction is purified by contacting the distillate fuel fraction with a metal oxide at elevated temperatures, and a distillate fuel blend component is isolated that comprises oxygenates in an amount of less than 1 weight % and has a total acid number of less than 1.5.

In a further aspect, the present invention relates to a process for producing a blended distillate fuel. The process comprises converting at least a portion of a hydrocarbon asset to synthesis gas, and converting at least a portion of the synthesis gas to a hydrocarbon stream in a Fischer-Tropsch process reactor. An olefinic distillate fuel fraction is isolated from the hydrocarbon stream, wherein the olefinic distillate fuel fraction comprises 2 to 80 weight % olefins and 20 to 98 weight % non-olefins, wherein the non-olefins comprise greater than 50 weight % paraffins. The olefinic distillate fuel fraction is purified by contacting the olefinic distillate fuel fraction with a metal oxide at elevated temperatures to provide a purified olefinic distillate fuel comprising oxygenates in an amount of less than 1 weight %. The purified olefinic distillate fuel fraction is mixed with a distillate fuel selected from the group consisting of a hydrocracked Fischer-Tropsch derived distillate fuel, a hydrotreated Fischer-Tropsch derived distillate fuel, a hydrocracked petroleum derived distillate fuel, a hydrotreated petroleum derived distillate fuel, and mixtures thereof. The blended distillate fuel comprises sulfur in an amount of less than 10 ppm by weight, has a total acid number of less 1.5, and forms less than 5 ppm peroxides after storage at 60° C. for 4 weeks.

In yet a further aspect, the present invention relates to a process for producing a blended distillate fuel. The process comprises providing an olefinic distillate fuel fraction comprising oxygenates in an amount of less than 1 weight %, 2 to 80 weight % olefins, and 20 to 98 weight % non-olefins, wherein the non-olefins comprise greater than 50 weight % paraffins. The olefinic distillate fuel fraction is mixed with a distillate fuel fraction selected from the group consisting of a hydrocracked Fischer-Tropsch derived distillate fuel, a hydrotreated Fischer-Tropsch derived distillate fuel, a hydrocracked petroleum derived distillate fuel, a hydrotreated petroleum derived distillate fuel, and mixtures thereof. The blended distillate fuel comprises sulfur in an amount of less than 10 ppm by weight, has a total acid number of less 1.5, and forms less than 5 ppm peroxides after storage at 60° C. for 4 weeks.

BRIEF DESCRIPTION OF THE DRAWINGS

The FIGURE is an illustration of a process to make a distillate fuel according to the present invention.

DETAILED DESCRIPTION OF THE ILLUSTRATIVE EMBODIMENTS

The present invention relates to a low sulfur, stable, olefinic blended distillate fuel wherein at least a portion of the blended distillate fuel is derived from a Fischer-Tropsch process and a process for producing this low sulfur, stable, olefinic blended distillate fuel.

Fuels containing low sulfur contents and relatively high olefin contents typically have problems with stability. In particular, these fuels rapidly form peroxides. Typically, hydroprocessing is used to saturate olefins and remove oxygenates from Fischer-Tropsch products and to improve stability. At least one of the blending components of the blended distillate fuels is processed to provide acceptable stability by a process other than typical hydroprocessing. Accordingly, the blended distillate fuels according to the present invention have relatively high olefin contents and are produced more economically than diesel fuels that have been completely hydroprocessed. The blending component that is processed by a process other than hydroprocessing does not require the use of expensive hydrogen gas.

The blended distillate fuels according to the present invention have relatively high olefin contents, low sulfur contents, and still exhibit acceptable stabilities. The blended distillate fuels comprises a distillate fuel fraction comprising olefins in an amount of 2 to 80 wt %, sulfur in an amount of less than 10 ppm by weight, and oxygenates in an amount of less than 1 wt %. The blended distillate fuels comprising the above distillate fuel fraction form less than 5 ppm peroxides after storage at 60° C. for four weeks.

Definitions

The following terms will be used throughout the specification and will have the following meanings unless otherwise indicated.

The term "distillate fuel" means a hydrocarbon material boiling between $C_5$ and 800° F., preferably between 280 and 750° F. $C_5$ analysis is performed by gas chromatography, and the temperatures refer to the 95% boiling points as measured by ASTM D-2887. Within the broad category of distillate fuels are specific fuels that include naphtha, diesel fuel, jet fuel, kerosene, aviation gas, fuel oil, and blends thereof, preferably diesel fuel.

The term "paraffin" means a saturated straight or branched chain hydrocarbon (i.e., an alkane).

The term "olefins" means an unsaturated straight or branched chain hydrocarbon having at least one double bond (i.e., an alkene).

The term "olefinic distillate fuel fraction" or "olefinic distillate fuel blend component" means a distillate fuel fraction containing less than 1 weight percent oxygenates, 2 to 80 wt % olefins, and 20 to 98 wt % non-olefins. The non-olefins are substantially comprised of paraffins. Preferably, olefinic distillate fuel fraction contains greater than or equal to 10 wt % olefins, more preferably greater than 25 wt % olefins and even more preferably greater than 50 wt % olefins. Preferably the non-olefins of the olefinic distillate fuel fraction comprise greater than 50 wt % paraffins, more preferably greater than 75 wt % paraffins, and even more preferably greater than 90 wt % paraffins (i.e., the percent paraffins is on the basis of the non-olefins). Preferably, the olefinic distillate fuel fraction also contains less than 10 ppm sulfur and less than 10 ppm nitrogen, and more preferably both sulfur and nitrogen are less than 5 ppm and even more preferably less than 1 ppm. Preferably the olefinic distillate fuel fraction contains less than 10 wt % aromatics, more preferably less than 5 wt % aromatics, and even more preferably less than 2 wt % aromatics. Olefins and aromatics are preferably measured by SCFC (Supercritical Fluid Chromatography).

The term "linear primary olefins" means a straight chain 1-alkene, commonly known as alpha olefins.

The term "total acid number" or "acid value" is a measurement of acidity. It is determined by the number of milligrams of potassium hydroxide required for the neutralization of acids present in 1 gram of the sample being measured (mg KOH/g), as measured by ASTM D 664 or a suitable equivalent. The blended distillate fuel according to the present invention preferably has a total acid number of less than 1.5 mg KOH/g and more preferably less than 0.5 mg KOH/g.

The term "oxygenates" means a hydrocarbon containing oxygen, i.e., an oxygenated hydrocarbon. Oxygenates include alcohols, ethers, carboxylic acids, esters, ketones, and aldehydes, and the like.

The term "i/n ratio" means isoparaffin/normal paraffin weight ratio. It is the ratio of the total number of iso-paraffins (i.e., branched) to the total number of normal-paraffins (i.e., straight chain) in a given sample.

The term "derived from a Fischer-Tropsch process" or "Fischer-Tropsch derived" means that the product, fraction, or feed originates from or is produced at some stage by a Fischer-Tropsch process.

The term "derived from a petroleum" or "petroleum derived" means that the product, fraction, or feed originates from the vapor overhead streams from distilling petroleum crude and the residual fuels that are the non-vaporizable remaining portion. A source of the petroleum derived can be from a gas field condensate The term "hydrotreated Fischer-Tropsch derived distillate fuel" means a distillate fuel that is derived from hydrotreating a $C_5$ to 750° F. containing Fischer-Tropsch product.

The term "hydrocracked Fischer-Tropsch derived distillate fuel" means a distillate fuel that is derived from hydrocracking a 750° F.+ containing Fischer-Tropsch product.

The term "hydrocracked petroleum derived distillate fuel" means a distillate fuel that is derived from hydrocracking 750° F.+ containing petroleum derived products.

The term "hydrotreated petroleum derived distillate fuel" means a distillate fuel that is derived from hydrotreating a $C_5$ to 750° F. containing petroleum derived product.

The term "elevated temperature" means temperatures greater than 20° C. In the process of the present invention, elevated temperatures with reference to the purification of the olefinic distillates, are preferably greater than 450° F. and more preferably greater than 600° F.

It has been surprisingly discovered that a low sulfur, blended distillate fuel can be prepared that has acceptable stability according to both conventional tests of stability and peroxide resistance. The blended distillate fuels of the present invention comprise an olefinic distillate fuel blend component. The blended distillate fuel of the present invention provides certain advantages over typical distillate fuels containing blending components derived from Fischer-Tropsch processes. For example, the costs associated with producing the olefinic distillate fuel blending component of the present invention, and hence the blended distillate fuel, are reduced because a hydroprocessing step, and thus expensive hydrogen, is not required to manufacture the olefinic distillate fuel blending component. In addition, the olefinic distillate fuel blend component and the blended fuel of the present invention have low sulfur contents and thus low sulfur emissions. Moreover, the blended distillate fuels of the present invention have acceptable stabilities as measured according to conventional measurements of stability (thermal and storage stability) and peroxide formation.

Accordingly, the present invention relates to a blended distillate fuel with acceptable stability comprising an olefinic distillate fuel blend component. The invention further relates to the process to produce the distillate fuel blend component and the blended distillate fuel. The olefinic distillate fuel blend component has a relatively high olefin content (2 to 80 wt %. preferably 10 to 80 wt %, more preferably 25 to 80 wt %, and even more preferably 50 to 80 wt %), a low sulfur content (less than 10 ppm by weight, preferably less than 5 ppm, and even more preferably less than 1 ppm), and an oxygenate content of less than 1 weight percent. The blended distillate fuel of the present invention comprising this olefinic blend component displays acceptable stability according to conventional tests of stability and acceptable peroxide resistance—forms less than 5 ppm peroxides after storage at 60° C. for four weeks.

At least a portion of the olefinic distillate fuel blend component of the present invention is made by a Fischer-Tropsch process, preferably the olefinic distillate fuel blend component is made by a Fischer-Tropsch process. In the Fischer-Tropsch process a hydrocarbon asset is converted to synthesis gas. The hydrocarbon asset can be selected from the group consisting of coal, natural gas, petroleum, and combinations thereof. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300 to 700° F. (149 to 371° C.) preferably about from 400° to 550° F. (204° to 228° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products may range from $C_1$ to $C_{200+}$ with a majority in the $C_5$–$C_{100+}$ range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079.

Suitable Fischer-Tropsch catalysts comprise on or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. No. 4,568,663.

The products from Fischer-Tropsch reactions performed in slurry bed reactors generally include a light reaction product and a waxy reaction product. The light reaction product (i.e. the condensate fraction) includes hydrocarbons boiling below about 700° F. (e.g., tail gases through middle distillates), largely in the $C_5$–$C_{20}$ range, with decreasing amounts up to about $C_{30}$. The waxy reaction product (i.e. the wax fraction) includes hydrocarbons boiling above about 600° F. (e.g., vacuum gas oil through heavy paraffins), largely in the $C_{20+}$ range, with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

The olefinic distillate fuel blend component of the present invention may be isolated from the products of the products of the Fischer-Tropsch process by distillation. The olefinic distillate fuel blend component boils between $C_5$ and 800° F., preferably between 280 to 750° F. The olefinic distillate fuel blend components of the present invention must be upgraded or purified to remove impurities so that when they are blended, they provide a blended distillate fuel with acceptable stability.

The olefinic distillate fuel blend component as isolated from Fischer-Tropsch facilities frequently contains impurities that should be removed, but without saturation of the olefins. Examples of these impurities include oxygenates, such as acids, and heavy metals. The acids that may be present in the olefinic distillate fuel blend component are corrosive and will rapidly attack metal surfaces in ships, tanks, pumps, and processing facilities. Since the acids attack metals, the metals will become incorporated into the distillate fuel and lead to increased fouling of furnace tubes in downstream processors. In addition, metals can be incorporated into the distillate fuel by direct reaction of the acids with typical Fischer-Tropsch catalysts—e.g. iron. Therefore, it is necessary to remove the acids and dissolved metals present in the olefinic distillate fuel blend component. Alcohols and other oxygenates may also be present in the olefinic distillate fuel blend component from the Fischer-Tropsch facility. It is desirable to remove them along with the dissolved metals and acids. Oxygenates are believed to contribute to the formation of peroxides in low-sulfur distillate fuels.

In processing conventional petroleum, it is standard that crude oils should have total acid numbers less than 0.5 mg KOH/g in order to avoid corrosion problem. It is further standard that distillate fractions have acid numbers less than 1.5 mg KOH/g. See, "Materials Selection for Petroleum Refineries and Gathering Facilities", Richard A. White, NACE International, 1998 Houston Tex. pages 6–9.

Typically, hydroprocessing is used to upgrade Fischer-Tropsch products to remove undesirable impurities such as oxygenates and improve stability. Hydroprocessing is the reaction of a hydrocarbonaceous feed with hydrogen over a catalyst at elevated temperature and pressure. The broad category of hydroprocessing can be divided into hydrotreating and hydrocracking. In hydrotreating, the goal is to remove heteroatoms, saturate olefins, saturate aromatics while minimizing the conversion to lower molecular weight species. Hydroprocessing requires the use of expensive hydrogen gas and saturates olefins in the feed.

Since hydroprocessing saturates olefins, the olefinic distillate fuel blend components of the present invention are upgraded or purified to remove impurities and to provide acceptable stability by a process other than hydroprocessing. Since the olefinic distillate fuel blend components are not hydroprocessed, the olefinic distillate fuel blend components of the present invention are produced more economically than hydroprocessed blend components, and hence the distillate fuel containing the olefinic blend components is produced more economically than a distillate fuel containing hydroprocessed blend components.

The upgrading process to remove impurities according to the present invention provides an olefinic distillate fuel blend component with an acceptable oxygenate content. It is believed that the oxygenate content must be reduced to a certain level to provide a stable distillate fuel. The upgrading process according to the present invention provides an olefinic distillate fuel blend component with an oxygenate content of less than 1 weight percent. While not wishing to be bound by any theory, it is believed that the oxygenate content can be linked to the development of peroxides during storage. Peroxides attack fuel system elastomers (O-rings, hoses, etc), and peroxide formation leads to a fuel with unacceptable stability. It is believed that the presence of oxygenates contributes to the peroxide formation. Accordingly, the upgrading process of the present invention provides an olefinic distillate fuel blend component with an oxygenate content of less than 1 weight percent.

The upgrading or purification process according to the present invention also provides a total acid number of preferably less than 1.5 mg KOH/g, more preferably less than 1.0 mg KOH/g, and even more preferably less than 0.5 mg KOH/g. The upgrading or purification process provides an olefinic distillate fuel blend component, which can be used to produce a blended distillate fuel that has acceptable stability and an acceptable total acid number, without saturating the olefins contained therein.

ASTM D975, "Standard Specification for Diesel Fuel Oils," describes stability measurements for diesel fuel. ASTM D6468, "Standard Test Method for High Temperature Stability of Distillate Fuels," is under consideration as a standard test method for diesel fuel and can provide a good measure of the stability of the fuel.

A blended distillate fuel comprising an olefinic blend component according to the present invention preferably will have an ASTM D6468 reflectance value when measured at 150° C. after 90 minutes of 65% or greater, preferably 80% or greater, and most preferably 90% or greater. For extremely stable materials, the test can be run at 180 minutes and materials should shown a reflectance of 65% or greater, preferably 80% or greater, and most preferably 90% or greater.

A blended distillate fuel comprising an olefinic distillate blend component according to the present invention will have an increase in peroxide number of less than about 5 ppm, preferably less than about 4 ppm, and even more preferably less than about 1 ppm after storage at 60° C. in an oven for 4 weeks.

According to the present invention, the upgrading or purification process is performed to remove oxygenates, including acids, and dissolved metals, and provides an olefinic distillate fuel blend component with acceptable oxygenate content. The upgrading process is performed by contacting the olefinic distillate fuel blend component with a metal oxide catalyst at elevated temperatures. In contacting the olefinic distillate fuel blend component with the metal oxide at elevated temperatures, acids are converted into paraffins and olefins by decarboxylation. In addition, alcohols are converted into additional olefins by dehydration, and other oxygenates (including ethers, esters, and aldehydes found at relatively smaller amounts) are converted into hydrocarbons. In this process for upgrading the distillate fuel blend component, expensive hydrogen is not needed; however, it can be used if desired (to improve catalyst/distillate fuel contacting or for heat control). The oxygen in the distillate fuel blend component is converted into water and carbon dioxide, which can easily be separated from the product olefinic distillate fuel blend component.

If dissolved metals are present in the olefinic distillate fuel, they will be simultaneously removed and deposited on the metal oxide catalyst. Typically, the metal oxide catalysts used in the upgrading process according to the present invention will show low deactivation rates; however, eventually the catalysts will need to be regenerated or replaced. Regeneration of the catalysts can be accomplished by stripping with a high temperature gas (hydrogen or other), or by burning the catalyst while it is in contact with an oxygen containing gas at elevated temperatures. Regeneration by burning is preferred.

Preferably the upgrading or purification process according to the present invention is performed by passing the olefinic distillate fuel blend component through a purification unit containing a metal oxide under conditions of 450 to 800° F., less than 1000 psig, and 0.25 to 10 LHSV without added gaseous components. Preferably, the metal oxide is selected from the group consisting of alumina, silica, silica-alumina, zeolites, clays, and mixtures thereof. Since terminal olefins are believed to provide a higher cetane number than internal olefins, it is preferable to select a metal oxide that is effective for dehydration of the oxygenates, but that does not promote isomerization of the olefins from their terminal position to internal or branched olefins. On this basis, a preferred metal oxide is alumina. Preferably the cetane number is greater than 50. Additional components can be added to the metal oxide to promote the dehydration or to retard olefin isomerization. Examples of such additional components are basic elements such as Group I or group II elements of the periodic table. These basic components can also retard catalyst fouling. Usually, these components are incorporated into the oxide in the form in the finished catalyst.

By way of example, the upgrading process may be performed by passing the olefinic distillate fuel downflow through a purification unit containing a metal oxide at elevated temperatures.

The severity of the upgrading or purification process can be varied as necessary to achieve the desired oxygenate content and total acid number. Typically the severity of the process is varied by adjusting the temperature, and LHSV. Accordingly, a more severe purification may be accomplished by running the purification process at a higher temperature, and under these more severe purification conditions more oxygenates will be removed thus providing an olefinic distillate fuel blend component with a lower oxygenates content and a lower total acid number. Preferably the upgrading or purification process is conducted at a temperature of 600 to 800° F. Preferably the upgrading or purification process is conducted at a LHSV of 0.5 to 2.

The upgrading processes of the present invention provides an olefinic distillate fuel blend component with an oxygenate content of less than 1 weight percent, without saturating the olefins contained therein. In addition, the upgrading processes preferably provide an olefinic distillate fuel blend component with a total acid number preferably less than 1.5 mg KOH/g, more preferably less than 1.0 mg KOH/g, and even more preferably less than 0.5 mg KOH/g, without significantly saturating the olefins contained therein. The upgrading processes of the present invention preferably remove more than 75, more preferably more than 80, and even more preferably more than 90 weight percent of the oxygenates in the olefinic distillate fuel blending component. Accordingly, the upgrading process according to the present invention comprises conditions of an oxygenate conversion of greater than 75%, more preferably greater than 80%, and even more preferably greater than 90%. The upgrading process of the present invention preferably reduces the acid number of the distillate fuel blend component by at least 25%, more preferably by at least 50% and even more preferably by at least 75%.

The olefinic distillate fuel blend component according to the present invention comprises 2 to 80 wt % olefins, less than 1 weight % oxygenates, and 20 to 98 wt % non-olefins. The non-olefins component of the blend component is substantially comprised of paraffins, preferably greater than 50 wt % paraffins (based on the non-olefin component). Preferably, olefinic distillate fuel blend component contains greater than or equal to 10 wt % olefins, more preferably greater than or equal to 25 wt % olefins, and even more preferably greater than or equal to 50 wt % olefins. The olefins of the olefinic distillate fuel blend component are predominantly linear primary olefins, thus providing a higher cetane number. Preferably, the olefins are greater than 50 wt % linear primary olefins, more preferably greater than 65 wt % linear primary olefins, and even more preferably greater than 80 wt % linear primary olefins.

The non-olefinic component of the olefinic distillate fuel blend component is predominantly paraffinic. Preferably the non-olefins are greater than 50 wt % paraffins, more preferably greater than 75 wt % paraffins, and even more preferably greater than 90 wt % paraffins. The paraffins of the non-olefinic component of the distillate fuel blend component are predominantly n-paraffins. Preferably the paraffins have an i/n ratio of less than 1.0 and more preferably less than 0.5.

In addition, preferably, the olefinic distillate fuel blend component contains less than 10 ppm sulfur, more preferably less than 5 ppm sulfur, and even more preferably less than 1 ppm sulfur. The olefinic distillate fuel blend component also preferably contains less than 10 ppm nitrogen, more preferably less than 5 ppm nitrogen and even more preferably less than 1 ppm nitrogen. Furthermore, the olefinic distillate fuel blend component preferably contains less than 10 wt % aromatics, more preferably less than 5 wt % aromatics, and even more preferably less than 2 wt % aromatics. Olefins and aromatics are preferably measured by SCFC (Supercritical fluid chromatograph).

The olefinic distillate fuel blend component according to the present invention may be used for any purpose for which a distillate fuel blend component is appropriate. Preferably, the olefinic distillate fuel blend component is appropriately blended to provide a distillate fuel. Blended fuels containing the olefinic distillate fuel blend component of the present invention form less than 5 ppm peroxides after storage at 60° C. for four weeks. Preferably, the blended fuels containing the olefinic distillate fuel blend component of the present invention meets the specifications for a diesel fuel and is used as such.

Accordingly, the olefinic distillate fuel blend components according to the present invention may be blended to provide a blended distillate fuel. This blended distillate may be used for any purpose for which a distillate fuel is used. Preferably the blended distillate fuel meets specifications for a diesel fuel as defined in ASTM D-975-98.

A blended distillate fuel comprises the olefinic distillate fuel blend component, as described above, and a distillate fuel fraction selected from the group consisting of a hydrotreated Fischer-Tropsch derived distillate fuel, a hydrocracked Fischer-Tropsch distillate fuel, a hydrotreated petroleum derived distillate fuel, a hydrocracked petroleum derived distillate fuel, and mixtures thereof. At least a portion of the blended distillate fuel of the present invention is derived from a Fischer-Tropsch process.

The blended distillate fuel according to the present invention comprises sulfur content of less than 10 ppm, preferably less than 5 ppm, and more preferably less than 1 ppm. The blended distillate fuel according to the present invention also has an acid number of less than 1.5 mg KOH/g, preferably less than 1.0 mg KOH/g, and more preferably less than 0.5 mg KOH/g. The blended distillate fuel also preferably contains less than 10 ppm nitrogen, more preferably less than 5 ppm, and even more preferably less than 1 ppm. In addition, the blended distillate fuel preferably contains less than 10 weight % aromatics, more preferably less than 5 weight % aromatics, and even more preferably less than 2 weight % aromatics.

The blended distillate fuel according to the present invention forms less than 5 ppm peroxides after storage at 60° C. for four weeks, preferably less than 4 ppm peroxides after storage at 60° C. for four weeks, and even more preferably less than 1 ppm peroxides after storage at 60° C. for four weeks.

The blended distillate fuel according to the present invention may meet the specifications for a diesel fuel and be used as such. Preferably, the blended distillate fuel meets specifications for a diesel fuel as defined in ASTM-975-98.

The blended distillate fuel according to the present invention may comprise varying amounts of olefinic distillate fuel blend component versus the other distillate fuel fraction, as defined above. Preferably the blended distillate fuel comprises 0.5 to 80 weight % olefinic distillate fuel blend component and 99.5 to 20 weight % other distillate fuel fraction. More preferably, the blended distillate fuel comprises 2 to 50 weight % olefinic distillate fuel blend component and 50 to 98 weight % other distillate fuel fraction.

The blended distillate fuel according to the present invention is made by a process comprising mixing an olefinic distillate fuel fraction or blend component, as defined herein, with a distillate fuel fraction selected from the group consisting of a hydrocracked Fischer-Tropsch derived distillate fuel, a hydrotreated Fischer-Tropsch derived distillate fuel, a hydrocracked petroleum derived distillate fuel, a hydrotreated petroleum derived distillate fuel, and mixtures thereof to provide a blended distillate fuel. A source of the petroleum desired distillate can be from a gas field condensate. The olefinic distillate fuel fraction or blend component has a composition as described herein and is made by processes as described herein. The blended distillate fuel comprises sulfur in an amount of less than 10 ppm by weight, has a total acid number of less 1.5, and forms less than 5 ppm peroxides after storage at 60° C. for 4 weeks. Preferably, the blended distillate fuel comprises less than 1 ppm sulfur. Also preferably the blended distillate fuel forms less than 4 ppm peroxides after storage at 60° C. for 4 weeks and even more preferably less than 1 ppm peroxides after storage at 60° C. for 4 weeks.

The blended distillate fuel according to the present invention is a superior distillate fuel in that it is stable and produced economically.

The blended distillate may further include other additives that are commonly used for diesel fuels. A description of additives that may be used in the present invention is as described in the Chevron Corporation, *Technical Review Diesel Fuels*, pp. 55–64 (2000), herein incorporated by reference in its entirety. In particular, these additives may include, but are not limited to, antioxidants (especially low sulfur antioxidants), lubricity additives, pour point depressants, and the like.

A preferred embodiment of the present invention is illustrated in the FIGURE. At a Fischer-Tropsch facility, methane (10) is mixed with oxygen and steam (neither shown) and reacted in a synthesis gas generator (20) to form a synthesis gas stream (30). The synthesis gas is reacted in a slurry phase Fischer-Tropsch unit (40) to produce a product (60). The product (60) is separated in a distillation until (70) to form a distillate fuel range material (80), which contains $C_5$ to 800° F. hydrocarbonaceous compounds. The olefinic distillate fuel is passed downflow through a purification unit (100) at 680° F., 50 psig, and 5 LHSV without added gaseous components. The purification unit contains alumina. The purification unit removes more than 80% of the oxygenated compounds, increases the olefin content, and reduces the acidity of the olefinic distillate fuel. A purified olefinic distillate fuel is produced (120) and shipped (140) to markets (180).

EXAMPLES

The invention will be further explained by the following illustrative examples that are intended to be non-limiting.

Example 1

Fischer-Tropsch Olefinic Distillates

Two olefinic distillates prepared by the Fischer-Tropsch process were obtained. The first (Feedstock A) was prepared by use of a iron catalyst. The second (Feedstock B) was prepared by use of an cobalt catalyst. The Fischer-Tropsch process used to prepare both feeds was operated in the slurry phase. Properties of the two feeds are shown below in Table 4 to follow.

Feedstock A contains significant amounts of dissolved iron and is also acidic. It has a significantly poorer corrosion rating.

For purposes of this invention, Feedstock B is preferable. It contains fewer oxygenates, has a lower acid content, and is less corrosive. Thus it is preferable to prepare olefinic distillate for use in blended fuels from cobalt catalysts rather than iron catalysts.

A modified version of ASTM D6550 (Standard Test Method for the Determination of the Olefin Content of Gasolines by Supercritical Fluid Chromatography—SFC) was used to determine the group types in the feedstocks and products. The modified method is to quantify the total amount of saturates, aromatics, oxygenates and olefins by making a 3-point calibration standard. Calibration standard solutions were prepared using the following compounds: undecane, toluene, n-octanol and dodecene. External standard method was used for quantification and the detection limit for aromatics and oxygenates is 0.1% wt and for olefins is 1.0% wt. Please refer to ASTM D6550 for instrument conditions.

A small aliquot of the fuel sample was injected onto a set of two chromatographic columns connected in series and transported using supercritical carbon dioxide as the mobile phase. The first column was packed with high surface area silica particles. The second column contained high surface area silica particles loaded with silver ions.

Two switching valves were used to direct the different classes of components through the chromatographic system to the detector. In a forward-flow mode, saturates (normal and branched alkanes and cyclic alkanes) pass through both columns to the detector, while the olefins are trapped on the silver-loaded column and the aromatics and oxygenates are retained on the silica column. Aromatic compounds and oxygenates were subsequently eluted from the silica column to the detector in a back flush mode. Finally, the olefins were back flushed from the silver-loaded column to the detector.

A flame ionization detector (FID) was used for quantification. Calibration was based on the area of the chromatographic signal of saturates, aromatics, oxygenates and olefins, relative to standard reference materials, which contain a known mass % of total saturates, aromatics, oxygenates and olefins as corrected for density. The total of all analyses was within 3% of 100% and normalized to 100% for convenience.

The weight percent olefins can also be calculated from the bromine number and the average molecular weight by use of the following formula:

Wt % Olefins=(Bromine No.)(Average Molecular Weight)/159.8.

It is preferable to measure the average molecular weight directly by appropriate methods, but it can also be estimated by correlations using the API gravity and mid-boiling point as described in "Prediction of Molecular Weight of Petroleum Fractions" A. G. Goossens, IEC Res. 1996, 35, p.985–988.

Preferably the olefins and other components are measured by the modified SFC method as described above.

A GCMS analysis of the feedstocks determined that the saturates were almost exclusively n-paraffins, and the oxygenates were predominantly primary alcohols, and the olefins were predominantly primary linear olefins (alpha olefins).

Example 2

Dehydration Catalysts

Commercial Silica Alumina and Alumina extrudates were evaluated for dehydration of the Olefinic Naphthas. Properties of the extrudates are shown below in Table 1.

TABLE 1

| | Extrudate | |
|---|---|---|
| | Silica Alumina | Alumina |
| Method of manufacture | 89% silica alumina powder bound with 11% alumina | Alumina extrudate |
| Particle Density, gm/cm3 | 0.959 | 1.0445 |
| Skeletal Density, gm/cm3 | 2.837 | |
| BET Surface area, m2/g | 416 | 217 |
| Geometric Average pore size, Angstroms | 54 | 101 |
| Macropore volume, cc/g (1000 + Angstroms) | 0.1420 | 0.0032 |
| Total pore volume, cc/g | 0.636 | 0.669 |

Example 3

Dehydration Over Silica Alumina

The dehydration experiments were performed in one inch downflow reactors without added gas or liquid recycle. The catalyst volume was 120 cc.

The Fe-based condensate (Feed A) was treated with the commercial silica alumina. This catalyst was tested at 50 psig and temperature of 480° F., 580° F., and 680° F. with space velocity at one LHSV and three LHSV. At one LHSV, the total olefin content was 69–70% at all three temperatures, which indicated full conversion of the oxygenates. At 680° F. some cracking was observed by the light product yields: total C4- was 1.2% and C5-290° F. was 25% (vs. 20% in the feedstock). At three LHSV and 480° F. and 580° F. the total olefins were lower at 53–55%. High dehydration activity was obtained at 680° F. and three LHSV with total olefin content of 69%. GCMS data indicated that significant amount of 1-olefin was converted to internal or branched olefins. The total olefins at 480° F. was 69% initially but was 55% near the end of the test (~960 hours on stream). Significant amount of carbon was observed on the catalyst after unloading the catalyst. The catalyst apparently fouled.

TABLE 2

| Dehydration PP72-457, Si—Al catalyst | Temp, F. | LHSV | Bromine method Bromine# | Bromine method % Olefin | GC-MS Data Alpha-olefins/Total olefins |
|---|---|---|---|---|---|
| Sample A | | | 50.6 | 51.6 | 90% |
| Product D | 680 | 3 | 71.7 | 70.3 | 5% |
| | 680 | 1 | 72.2 | 70.5 | 6% |

The detailed analysis of the product (D) from the test at 3 LHSV and 680° F. is shown below in Table 4.84% of the oxygen was removed, the corrosion rating was improved, and iron was reduced to below the level of detection. The acidity of the naphtha was reduced by 25%. The oxygenates were converted to olefins as shown by the increase in olefin content and the decrease in oxygenate content.

TABLE 3

| Dehydration alumina catalyst Sample ID | Temp, F. | LHSV | SFC method Oxygenates, % wt | Bromine method Bromine# | Bromine method % Olefin | GC-MS Data Alpha-olefins/Total olefins | C4- Gas Yields, Wt % | Total Acid No. |
|---|---|---|---|---|---|---|---|---|
| Feed B: | | | 8.5 | 20.4 | 24.2 | 94% | | 0.86 |
| B1 | 480 | 1 | 7.4 | 21.3 | 25.2 | 92% | 0.32 | |
| B2 | 580 | 1 | 0.9 | 27.5 | 31.8 | 85% | <0.5 | |
| B3 | 580 | 1 | 0.8 | 28.2 | 33.1 | 91% | 0.34 | 0.6 |
| B4 | 580 | 1 | 0.9 | 27.1 | 31.1 | 93% | 0.36 | |
| B5 | 580 | 2 | 1.3 | 27.1 | 31.3 | 86% | <0.5 | |
| B6 | 580 | 3 | 2.1 | 26.5 | 30.6 | 86% | <0.5 | 0.48 |
| B7 | 630 | 1 | 0.6 | 27.9 | 32.2 | 78% | 0.46 | 0.32 |
| B8 | 630 | 2 | 0.8 | 28.1 | 32.4 | 79% | 0.38 | |
| B9 | 630 | 3 | 0.8 | 29.4 | 33.9 | 86% | 0.24 | 0.63 |
| B10 | 630 | 4 | 1.0 | 28.7 | 33.1 | 87% | 0.20 | |
| B11 | 630 | 5 | 1.1 | 27.1 | 31.1 | 83% | 0.18 | 0.67 |
| B12 | 680 | 1 | <0.1 | 31.1 | 35.6 | 4% | 0.51 | 0.06 |
| B13 | 680 | 2 | 0.3 | 26.7 | 30.8 | 30% | 0.40 | 0.18 |
| B14 | 680 | 3 | 0.5 | 26.5 | 30.6 | 71% | 0.33 | |
| B15 | 680 | 3 | 0.6 | 26.9 | 31.1 | 78% | <0.5 | |
| B16 | 680 | 4 | 0.6 | 27.6 | 32.0 | 76% | <0.5 | |
| B17 | 680 | 4 | 0.6 | 29.1 | 33.3 | 73% | 0.20 | |
| Product C | 680 | 5 | 0.7 | 28.1 | 32.3 | 78% | 0.18 | 0.39 |
| C1 | 680 | 5 | 0.7 | 27.8 | 31.9 | 79% | <0.5 | |
| C2 | 730 | 3 | 0.1 | 31.8 | 36.1 | 7% | 0.33 | 0.12 |

Example 4

Dehydration Over Alumina

The Co-based cold condensate (Feedstock B) was also treated as in Example 2, but with the alumina catalyst. Temperatures from 480° F. to 730° F. and LHSV values from one to five were explored. At high temperature and one LHSV, GCMS data indicated that the double bond isomerization was significant (reduced alpha-olefin content). At five LHSV and 580° F., dehydration conversion was significantly lower, and the majority of the olefins were primary linear olefins. This test ran 2000 hours with no indication of fouling.

These results show that it is possible to eliminate all the oxygenates from the sample and convert them to olefins. At high oxygenate removal levels, a significant portion of the alpha olefins are isomerized to internal olefins, but this does not decrease their value as a distillate fuel or a distillate fuel blend component.

Product (C) was prepared from operation at five LHSV and 680° F. Detailed properties are shown below in Table 4.87% of the oxygen is removed, the acidity was reduced by 55%, and the trace of iron in the sample was removed. The acidity of the final material was below 0.5 mg KOH/g, the typical maximum for petroleum crudes. The oxygenates were converted to olefins as shown by the increase in olefin content which approximately matched the decrease in oxygenate content.

TABLE 4

| | Experiment No. | | | |
|---|---|---|---|---|
| | 1 | 2 | 1 | 3 |
| Feed/Product ID | Fe Cond. A | Product D | Co Cond. B | Product C |
| Process conditions | | | | |
| Catalyst | None | SiAl | None | Alumina |
| LHSV, h-1 | — | 3 | — | 5 |
| Temperature, F. | — | 680 | — | 680 |
| Pressure, psig | — | 50 | — | 50 |
| Run hours | — | 582–678 | — | 1026–1122 |
| API | 56.5 | 58.1 | 56.6 | 57.9 |
| Bromine No. | 50.6 | 71.7 | 21 | 27.6 |
| Average molecular weight | 163 | 157 | 183 | 184 |
| Wt % Olefin (calc. from Br2 No.) | 51.6 | 70.3 | 24 | 32 |
| KF Water, ppm wt | 494 | 58 | 530 | 57 |
| Oxygen by NAA, wt % | 1.61 | 0.26 | 0.95 | 0.12 |
| SFC Analysis, Wt % | | | | |
| Saturates | 33.5 | 35.1 | 67.4 | 68.0 |
| Aromatics | 1.2 | 1.5 | 0.3 | 0.4 |
| Olefins | 55.7 | 62.2 | 23.7 | 30.9 |
| Oxygenates | 9.6 | 1.2 | 8.6 | 0.7 |
| Acid Test | | | | |
| Total Acid, mg KOH/g | 3.17 | 2.33 | 0.86 | 0.39 |
| UF EP, mg KOH/g | 3.10 | 2.30 | 0.84 | 0.35 |
| Cu Strip Corrosion | | | | |
| Rating | 2c | 2a | 1b | 1b |
| Sulfur, ppm wt | <1 | n/a | <1 | <1 |
| Nitrogen, ppm | 0.56 | n/a | 1.76 | 1.29 |
| ASTM D2887 Simulated Distillation by wt %, ° F. | | | | |
| 0.5 | 86 | 102 | 76 | 91 |
| 10 | 237 | 214 | 243 | 247 |
| 30 | 301 | 303 | 339 | 338 |
| 50 | 373 | 356 | 415 | 414 |
| 70 | 417 | 417 | 495 | 486 |
| 90 | 484 | 485 | 569 | 572 |
| 95 | 517 | 518 | 596 | 599 |
| 99.5 | 639 | 622 | 662 | 666 |
| Metals by ICP, ppm | | | | |
| Fe | 44.960 | 0.980 | 2.020 | <0.610 |
| Zn | 2.610 | <0.380 | <0.360 | <0.350 |

Metal elements below ICP limit of detection in all samples: Al, B, Ba, Ca, Cr, Cu, K, Mg, Mo, Na, Ni, P, Pb, S, Si, Sn, Ti, V.

Example 5

Adsorption of Oxygenates

Trace levels of oxygenates not removed by the high temperature treatment can be removed by adsorption using sodium X zeolite (commercial 13X sieve from EM Science, Type 13X, 8–12 Mesh Beads, Part Number MX1583T-1).

The adsorption test was carried out in a up-flow fixed bed unit. The feed for the adsorption studies was produced by processing the Co condensate (Feed B) over alumina at 5 LHSV, 680° F. and 50 psig. The feed for the adsorption studies had acid number of 0.47 and oxygenate content by SFC of 0.6%.

Process conditions for the adsorption were: ambient pressure, room temperature, and 0.5 LHSV. The oxygenate content of the treated products was monitored by the SFC method. The adsorption experiment was continued until breakthrough—defined as the appearance of an oxygenate content of 0.1% or higher. The breakthrough occurred at when the sieve had adsorbed an equivalent amount of 14 wt % based on the feed and product oxygenates. The product after treatment showed 0.05 wt % oxygen by neutron activation, <0.1 ppm nitrogen, and total acid number of 0.09.

The adsorbent could be regenerated by known methods: oxidative combustion, calcinations in inert atmosphere, water washing, and the like, and in combinations.

These results demonstrate that adsorption processes can also be used for oxygenate removal. They can be used as such, or combined with dehydration.

Example 6

Stability of Blends of Dehydrated Condensate

The stabilities of Samples A-D of Example 4 were evaluated when blended with a Fischer-Tropsch product that was fully hydroprocessed. The properties of the fully hydroprocessed stock (Sample E) are shown below:

| Property | Value |
|---|---|
| Gravity, ° API | 52.7 |
| Nitrogen, ppm | 0.24 |
| Sulfur, ppm | <1 |
| Water, ppm by Karl Fisher, ppm | 21.5 |
| Pour Point/Cloud Point/CFPP, ° C. | −23/−18/−21 |
| Flash Point, ° C. | 58 |
| Autoignition Temperature, ° F. | 475 |
| Viscosity at 25° C./40° C., cSt | 2.564/1.981 |
| Cetane Number | 74 |
| Aromatics by Supercritical Fluid Chromatography, wt % | <1 |
| Stability, D6468% Reflectance after 180 min at 150° C. | >99 |
| Acid Neutralization No. | 0 |
| Ash Oxide, Wt % | <0.001 |
| Ramsbottom Carbon Residue, wt % | 0.02 |
| Cu Strip Corrosion | 1A |
| Color, ASTM D1500 | 0 |
| GC-MS Analysis | |
| Paraffins, Wt % | 100 |
| Paraffin i/n ratio | 2.1 |
| Oxygen as oxygenates, ppm | <6 |
| Olefins, Wt % | 0 |
| Average Carbon Number | 15.15 |

| Distillation by D-2887 by Wt %, ° F. and D-86 by Vol %, ° F. | D-2887 | D-86 |
|---|---|---|
| 0.5/5 | 255/300 | 329/356 |
| 10/20 | 326/368 | 366/393 |
| 30/40 | 406/449 | 419/449 |
| 50 | 487 | 480 |
| 60/70 | 523/562 | 510/539 |
| 80/90 | 600/637 | 567/597 |
| 95/99.5 | 659/705 | 615/630 |

Various combination of this fully hydrogenated stock and samples A-D were prepared and evaluated for stability with respect to peroxide formation.

Blends fully processed product E with untreated Fe condensate Sample A

| Sample | Weight % | | Peroxide Result after storage at 60 C., ppm | | | | |
|---|---|---|---|---|---|---|---|
| No. | E | A | Initial | 1 Wk | 2 Wk | 3 Wk | 4 Wk |
| 1 | 100 | 0 | <1 | <1 | <1 | <1 | <1 |
| 2 | 99.8 | 0.2 | <1 | <1 | <1 | <1 | 1 |
| 3 | 99.5 | 0.5 | 1.1 | 1.3 | 1.9 | 3.4 | 7.7 |
| 4 | 99 | 1 | 1.6 | 12 | 32 | 50 | 62 |
| 5 | 98 | 2 | 3 | 38 | 59 | 97 | 100 |
| 6 | 90 | 10 | 15 | 34 | 48 | 63 | 72 |

Blends fully processed product E with SiAl treated Fe condensate Sample D

| Sample | Weight % | | Peroxide Result after storage at 60 C., ppm | | | | |
|---|---|---|---|---|---|---|---|
| No. | E | D | Initial | 1 Wk | 2 Wk | 3 Wk | 4 Wk |
| 7 | 99.8 | 0.2 | <1 | <1 | <1 | <1 | <1 |
| 8 | 99.5 | 0.5 | <1 | <1 | <1 | <1 | <1 |
| 9 | 99 | 1 | <1 | <1 | <1 | <1 | 1 |
| 10 | 98 | 2 | <1 | 1 | 1 | 1.9 | 3.7 |
| 11 | 90 | 10 | 2 | 8 | 55 | 99 | 144 |

Blends fully processed product E with untreated Co condensate Sample B

| Sample | Weight % | | Peroxide Result after storage at 60 C., ppm | | | | |
|---|---|---|---|---|---|---|---|
| No. | E | B | Initial | 1 Wk | 2 Wk | 3 Wk | 4 Wk |
| 12 | 99.8 | 0.2 | 1 | <1 | <1 | <1 | <1 |
| 13 | 99.5 | 0.5 | <1 | <1 | <1 | <1 | <1 |
| 14 | 99 | 1 | <1 | <1 | <1 | <1 | 1 |
| 15 | 98 | 2 | <1 | 1 | 1 | 1.9 | 3.8 |
| 16 | 90 | 10 | 1.4 | 42 | 63 | 88 | 104 |

Blends fully processed product E with Al2O3 treated Co condensate Sample C

| Sample | Weight % | | Peroxide Result after storage at 60 C., ppm | | | | |
|---|---|---|---|---|---|---|---|
| No. | E | C | Initial | 1 Wk | 2 Wk | 3 Wk | 4 Wk |
| 17 | 99.8 | 0.2 | <1 | <1 | <1 | <1 | <1 |
| 18 | 99.5 | 0.5 | <1 | 1.4 | <1 | <1 | <1 |
| 19 | 99 | 1 | <1 | <1 | <1 | <1 | 1 |
| 20 | 98 | 2 | <1 | 1.6 | <1 | <1 | 1 |
| 21 | 90 | 10 | 2 | 2.2 | 4.5 | 7.1 | 18 |

These results show that the fully hydroprocessed sample has excellent stability with respect to peroxide formation. It also shows that the untreated condensates, especially the iron condensate, has a very poor peroxide stability. Treating either the iron or the cobalt condensates to remove the oxygenates improves the stability. Increasing the content of the untreated blends tends to decrease the stability, but the stability of the blend depends on the nature of the untreated component. Also the maximum amount of untreated material that can be put in the blend before the blend shows greater than 5 ppm peroxides after 4 weeks varies depends on the nature of the untreated component. Blends of the alumina treated Co condensate that contain low levels of oxygenates show less than 5 ppm peroxides after 4 weeks of storage when the amount of the treated condensate less than 10%.

These results show that stable products made from highly olefinic components can be prepared. The stability appears to depend on the extent of removal of oxygenates.

Example 7

Stability Tests on Highly Deoxygenated Samples

A Co condensate is treated at 680° F., 1 LHSV, and 50 psig according to the data presented in Table 3, to generate a product containing less than 0.1 wt % oxygenates, a bromine number of 31.1, and olefins content calculated from the bromine number of 35.6. The material has an acid number of 0.06. This material is blended with the hydrogenated product E, from Example 6, and blends containing greater than 10% treated condensate show less than 5 ppm peroxides after storage for 4 weeks.

Various modifications and alterations of this invention will become apparent to those skilled in the art without departing from the scope and spirit of this invention. Other objects and advantages will become apparent to those skilled in the art from a review of the preceding description.

That which is claimed is:

1. A blended distillate fuel comprising:

a) a distillate fuel fraction comprising olefins in an amount of 2 to 80 weight %; non-olefins in an amount of 20 to 98 weight %, wherein the non-olefins comprise greater than 50 weight % paraffins; and oxygenates in an amount of less than 1 weight %; and b) a distillate fuel fraction selected from the group consisting of a hydrotreated Fischer-Tropsch derived distillate fuel, a hydrocracked Fischer-Tropsch derived distillate fuel, a hydrotreated petroleum derived distillate fuel, a hydrocracked petroleum derived distillate fuel, and mixtures thereof;

wherein at least a portion of the blended distillate fuel is derived from Fischer-Tropsch synthesis products and the blended distillate fuel comprises sulfur in an amount of less than 10 ppm by weight, has a total acid number of less 1.5, and forms less than 5 ppm peroxides after storage at 60° C. for 4 weeks.

2. A blended distillate fuel according to claim 1, wherein the blended distillate fuel comprises sulfur in an amount of less than 5 ppm by weight.

3. A blended distillate fuel according to claim 1, wherein the blended distillate fuel comprises sulfur in an amount of less than 1 ppm by weight.

4. A blended distillate fuel according to claim 1, wherein the distillate fuel fraction of (a) comprises at least 10 weight % olefins.

5. A blended distillate fuel according to claim 1, wherein the non-olefins of the distillate fuel fraction of (a) comprises greater than 75 weight % paraffins.

6. A blended distillate fuel according to claim 1, wherein the distillate fuel fraction of (a) is derived from Fischer-Tropsch synthesis products.

7. A blended distillate fuel according to claim 1, wherein the olefins of the distillate fuel fraction of(a) are comprised of greater than 50 weight % linear primary olefins.

8. A blended distillate fuel according to claim 1, wherein the olefins of the distillate fuel fraction of (a) are comprised of greater than 65 weight % linear primary olefins.

9. A blended distillate fuel according to claim 1, wherein the paraffins of the distillate fuel fraction of (a) have an i/n ratio of less than 1.

10. A blended distillate fuel according to claim 1, wherein the blended distillate fuel further comprises less than 5 weight % aromatics and nitrogen in an amount of less than 5 ppm by weight.

11. A blended distillate fuel according to claim 1, wherein the blended distillate fuel comprises a total acid number of less than 0.5.

12. A blended distillate fuel according to claim 1, wherein the blended distillate fuel meets specifications for a diesel fuel as defined in ASTM D-975-98.

13. A blended distillate fuel according to claim 1, wherein the blended distillate fuel forms less than 4 ppm peroxides after storage at 60° C. for 4 weeks.

14. A blended distillate fuel according to claim 1, wherein the blended distillate fuel forms less than 1 ppm peroxides after storage at 60° C. for 4 weeks.

15. A blended distillate fuel comprising:

a) a Fischer-Tropsch distillate fuel fraction comprising:

(i) olefins in an amount of 2 to 80 weight %;

(ii) non-olefins in an amount of 20 to 98 weight %, wherein the non-olefins comprise greater than 75 weight % paraffins and the paraffins have an un ratio of less than 1; and (iii) oxygenates in an amount of less than 1 weight %; and b) a distillate fuel fraction selected from the group consisting of a hydrotreated Fischer-Tropsch derived distillate fuel, a hydrocracked Fischer-Tropsch derived distillate fuel, a hydrotreated petroleum derived distillate fuel, a hydrocracked petroleum derived distillate fuel, and mixtures thereof;

wherein the blended distillate fuel comprises (i) sulfur in an amount of less than 1 ppm by weight, (ii) nitrogen in an amount of less than 5 ppm by weight;

(iii) aromatics in an amount of less than 5 weight % and (iv) a total acid number of less than 1.5; wherein the blended distillate fuel forms less than 5 ppm peroxides after storage at 60° C. for 4 weeks.

16. A blended distillate fuel according to claim 15, wherein the blended distillate fuel forms less than 4 ppm peroxides after storage at 60° C. for 4 weeks.

17. A blended distillate fuel according to claim 15, wherein the blended distillate fuel meets specifications for a diesel fuel as defined in ASTM D-975-98.

18. A blended distillate fuel according to claim 15, wherein the Fischer-Tropsch distillate fuel fraction of (a) comprises at least 10 weight % olefins.

19. A Fischer-Tropsch distillate fuel blend component comprising:

a) olefins in an amount of 2 to 80 weight %;

b) non-olefins in an amount of 20 to 98 weight %, wherein the non-olefins comprise greater than 75 weight % paraffins and the paraffins have an i/n ratio of less than 1;

c) oxygenates in an amount of less than 1 weight %;.

d) sulfur in an amount of less than 1 ppm by weight;

e) aromatics in an amount of less than 2 weight %;

f) a total acid number of less than 1.5; and g) a boiling range of $C_5$ to 800° F.

20. A Fischer-Tropsch distillate blend component according to claim 19, wherein the distillate blend component comprises at least 10 weight % olefins.

* * * * *